US011465796B2

(12) United States Patent
Bowden et al.

(10) Patent No.: US 11,465,796 B2
(45) Date of Patent: Oct. 11, 2022

(54) HIGH SPEED DUAL LABEL APPLICATOR

(71) Applicant: ID Technology LLC, Fort Worth, TX (US)

(72) Inventors: Mark N. Bowden, Nokomis, FL (US); James F. Butt, New Freedom, PA (US); Matthew D. McLean, Owings Mills, MD (US)

(73) Assignee: ID TECHNOLOGY LLC, Fort Worth, TX (US)

( * ) Notice: Subject to any disclaimer, the term of this patent is extended or adjusted under 35 U.S.C. 154(b) by 60 days.

(21) Appl. No.: 16/775,373

(22) Filed: Jan. 29, 2020

(65) Prior Publication Data

US 2020/0262598 A1 Aug. 20, 2020

Related U.S. Application Data

(60) Provisional application No. 62/806,355, filed on Feb. 15, 2019.

(51) Int. Cl.

| | |
|---|---|
| ***B65C 11/00*** | (2006.01) |
| ***B65C 9/18*** | (2006.01) |
| ***B65C 9/42*** | (2006.01) |
| ***B65C 9/28*** | (2006.01) |

(52) U.S. Cl.

CPC ..... *B65C 11/008* (2013.01); *B65C 9/18* (2013.01); *B65C 9/28* (2013.01); *B65C 9/42* (2013.01); *B65C 11/004* (2013.01)

(58) Field of Classification Search

CPC .... B65C 9/18; B65C 9/28; B65C 9/40; B65C 9/42; B65C 11/004; B65C 11/008

See application file for complete search history.

(56) References Cited

U.S. PATENT DOCUMENTS

| | | | | |
|---|---|---|---|---|
| 3,779,829 | A | 12/1973 | Wolff | |
| 3,970,507 | A * | 7/1976 | Dalzell | B65C 3/12 156/446 |
| 4,008,119 | A | 2/1977 | Hermann | |
| 4,032,388 | A | 6/1977 | Dunning | |
| 4,087,057 | A | 5/1978 | Sato | |
| 4,116,747 | A | 9/1978 | Hamisch, Jr. | |
| 4,142,932 | A | 3/1979 | Hamisch, Jr. | |
| 4,148,679 | A | 4/1979 | Hamisch, Jr. | |
| 4,153,217 | A | 5/1979 | Hamisch, Jr. | |
| 4,153,495 | A | 5/1979 | Hamisch, Jr. | |
| 4,158,590 | A | 6/1979 | Hamisch, Jr. | |
| 4,166,757 | A | 9/1979 | Hamisch, Jr. | |

(Continued)

*Primary Examiner* — George R Koch

(74) *Attorney, Agent, or Firm* — Thompson Hine LLP

(57) ABSTRACT

A labeling system includes a frame component pivotal between a label load position, a first label apply position and a second label apply position. A vacuum applicator is carried on the frame component for movement with the frame component. A first actuator is configured for pivoting the frame component between the label load position and the first label apply position. A second actuator is configured for pivoting the frame component from the label load position to the second label apply position. The second label apply position is located between the label load position and the first label apply position. The labeling system can be used to apply one label to the leading side of an item moving along a conveyance path, and to apply another label to the lateral side of the same item.

15 Claims, 8 Drawing Sheets

(56) References Cited

U.S. PATENT DOCUMENTS

| | | | | |
|---|---|---|---|---|
| 4,172,753 | A | 10/1979 | Benoit | |
| 4,187,778 | A | 2/1980 | Holland-Letz | |
| 4,204,901 | A | 5/1980 | Hamisch, Jr. | |
| 4,204,902 | A | 5/1980 | Hamisch, Jr. | |
| 4,337,108 | A | 6/1982 | Crankshaw | |
| 4,366,023 | A | 12/1982 | Voltmer | |
| 4,369,085 | A | 1/1983 | Hermann | |
| 4,393,774 | A | 7/1983 | Figg | |
| 4,680,082 | A | 7/1987 | Kearney | |
| 4,844,771 | A | 7/1989 | Crankshaw | |
| 4,922,775 | A | 5/1990 | Winter | |
| 5,024,718 | A | 6/1991 | Hannen | |
| 5,399,228 | A | 3/1995 | Schroeder | |
| 5,421,948 | A * | 6/1995 | Crankshaw | B65C 9/30 156/542 |
| 5,660,676 | A | 8/1997 | Brooks | |
| 5,733,410 | A | 3/1998 | Gore | |
| 6,368,446 | B1 | 4/2002 | McNestry | |
| 6,596,105 | B2 | 7/2003 | Kendall, Jr. | |
| 6,640,865 | B1 | 11/2003 | Morikawa | |
| 6,796,352 | B1 | 9/2004 | Geurtsen | |
| 7,462,252 | B2 * | 12/2008 | Schaller | B65C 1/045 156/202 |
| 8,505,450 | B2 | 8/2013 | Bangel | |
| 10,106,286 | B2 | 10/2018 | Snedecor | |
| 10,179,669 | B2 | 1/2019 | Korthauer | |
| 2003/0041973 | A1 * | 3/2003 | Soto | B65C 9/1869 156/566 |
| 2005/0263535 | A1 * | 12/2005 | Smith | B65C 9/26 221/73 |
| 2007/0074809 | A1 | 4/2007 | Phillips | |
| 2009/0126850 | A1 | 5/2009 | Fletcher | |

* cited by examiner

HIGH SPEED DUAL LABEL APPLICATOR

TECHNICAL FIELD

This application relates generally to the application of labels to items moving along a conveyance path and, more specifically, to a label applicator for applying labels to two different sides or panels of an item.

BACKGROUND

Supply chains are becoming more dependent on barcode labeling which can be challenging for high volume packaging lines. In many cases, the manufacture of consumer or medical products is required to apply labels to two sides of a shipping case or a shrink-wrapped tray, and such dual application is difficult to achieve with existing equipment, particularly at the high throughput desired.

It would be desirable to provide a label applicator capable of effectively and efficiently applying distinct labels to two different sides of an item moving along a packaging line conveyance path.

SUMMARY

In one aspect, a labeling system includes a frame component pivotal between a label load position, a first label apply position and a second label apply position. A vacuum applicator is carried on the frame component for movement with the frame component. A first actuator is configured for pivoting the frame component between the label load position and the first label apply position. A second actuator is configured for pivoting the frame component from the label load position to the second label apply position. The second label apply position is located between the label load position and the first label apply position.

In one implementation of the labeling system, a conveyance path is provided along which an item to be labeled can be conveyed in a conveyance direction. The frame component is positioned alongside the conveyance path when in the label load position. The first actuator is a linear actuator having an extended state and a retracted state. The second actuator is a linear actuator having an extended state and a retracted state. A controller is connected for controlling both the first actuator and the second actuator, wherein the controller is configured to: (a) maintain the first actuator in its retracted state and maintain the second actuator in its retracted state to place the frame component in the label load position while a first label is loaded onto the vacuum applicator; (b) cause at least the first actuator to move to its extended state in order to pivot the frame component into the first label apply position for application of the first label to a leading side of the item moving in the conveyance direction along the conveyance path; (c) cause at least the first actuator to move to its retracted state in order to move the frame component back into the label load position while a second label is loaded onto the vacuum applicator; and (d) cause the second actuator to move to its extended state in order to pivot the frame component into the second label apply position for application of the second label to a lateral side of the item moving in the conveyance direction along the conveyance path.

In another aspect, a labeling system includes a conveyor for moving an item in a conveyance direction along a conveyance path. A label applicator is pivotal between a label load position, a lateral side label apply position and a leading side label apply position, wherein, in the label load position, the label applicator is alongside the conveyance path, wherein, in the leading side label apply position, the label applicator is pivoted into the conveyance path, wherein, in the lateral side label apply position the label applicator is pivoted out of the label load position and closer to the conveyance path. A label feed device is positioned for feeding a label onto the label applicator when the label applicator is in the label load position. An actuating assembly is provided for controlling pivot of the label applicator. A controller is associated with the actuating assembly, the label feed device and the label applicator for control thereof. The controller is configured to: (a) control the label feed device to feed a first label onto the label applicator when the label applicator is in the label load position; (b) control the actuating system to pivot the label applicator into the leading side label apply position such that the first label is oriented with an adhesive side facing a leading side of the item; (c) control the label applicator to eject the first label from the label applicator and onto the leading side of the item; (d) control the actuating assembly to pivot the label applicator out of the conveyance path and back into the label load position; (e) control the label feed device to feed a second label onto the label applicator when the label applicator is in the label load position; (f) control the actuating assembly to pivot the label applicator toward the conveyance path into the lateral side label apply position such that an adhesive side of the second label is alongside a lateral side of the item; and (g) control the label applicator to eject the second label from the label applicator and onto the lateral side of the item.

In one implementation of the foregoing aspect, the actuating assembly is comprised of first and second linear actuators. In one example of this implementation, the linear actuators are pneumatic actuators.

In a further aspect, a method of applying labels to an item moving in a conveyance direction along a conveyance path involves the steps of: (a) utilizing a pivotal label applicator that is in a label load position out of the conveyance path; (b) loading a first label onto the label applicator when the label applicator is in the label load position; (c) pivoting the label applicator into the conveyance path such that the first label is oriented with an adhesive side facing a leading side of the item, and ejecting the first label from the label applicator and onto the leading side; (d) pivoting the label applicator away from the conveyance path and back into the label load position; (e) loading a second label onto the label applicator when the label applicator is in the label load position; and (f) pivoting the label applicator toward the conveyance path such that an adhesive side of the second label is alongside a lateral side of the item, and ejecting the second label from the label applicator and onto the lateral side of the item.

In one implementation of the method, the pivotal label applicator includes a first linear actuator and a second linear actuator. In step (c), both the first linear actuator and the second linear actuator are actively extended in order to pivot the label applicator out of the label load position. In step (f), only the second label applicator is actively extended in order to pivot the label applicator, and the first label applicator partially extends in a passive manner.

According to the aspects, the labeling system prints and applies a label on adjacent sides of a product at higher output speeds than was previously possible. The label applicator module has two motions, one that moves a vacuum applicator pad to apply the label to the leading face of the product and one that moves just a short distance to apply a second label to the side of the product.

DETAILED DESCRIPTION

Figure 1:
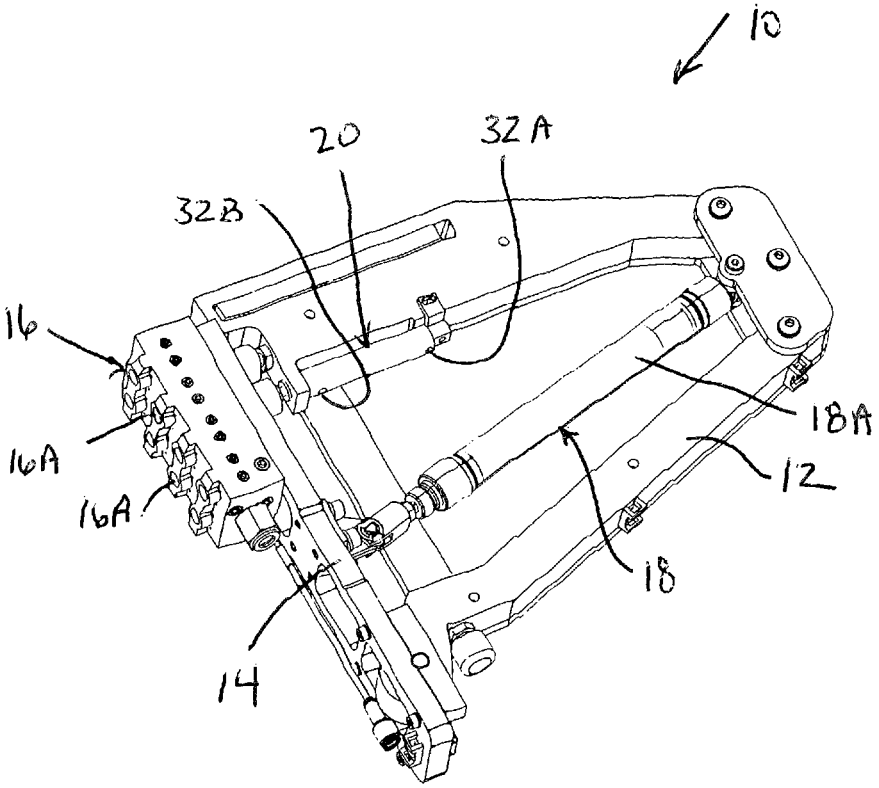
FIG. 1 is a perspective view of a labeling assembly.
Figure 2:
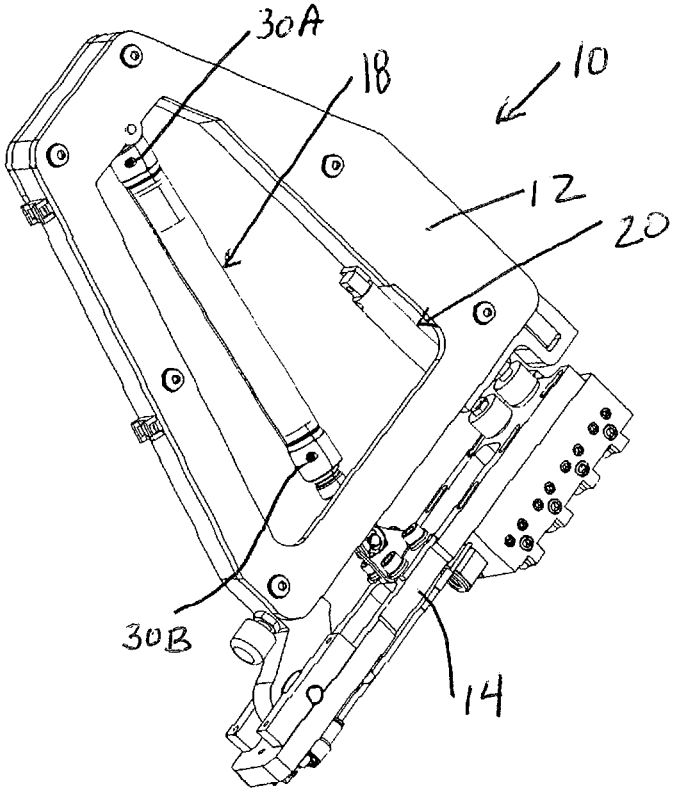
FIG. 2 is another perspective view of the labeling assembly.
Figure 3:
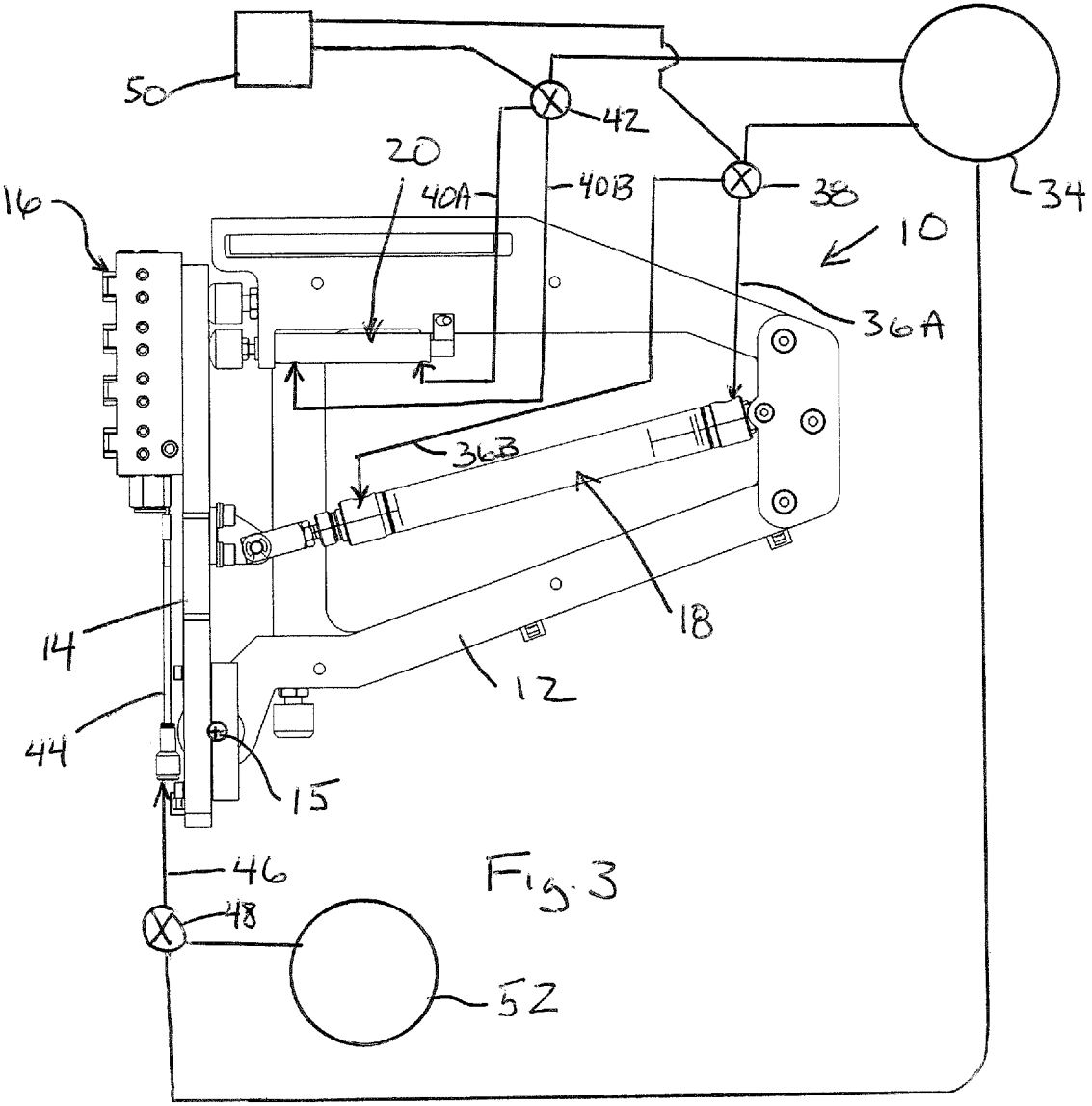
FIG. 3 is top plan view of the labeling assembly in a label load orientation.
Figure 4:
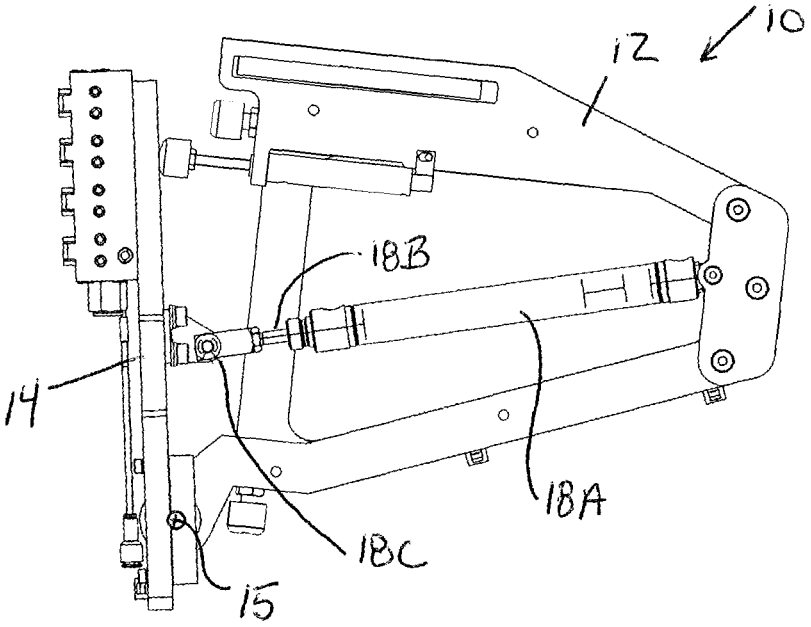
FIG. 4 is a top plan view of the labeling assembly in a lateral side label apply orientation.
Figure 5:
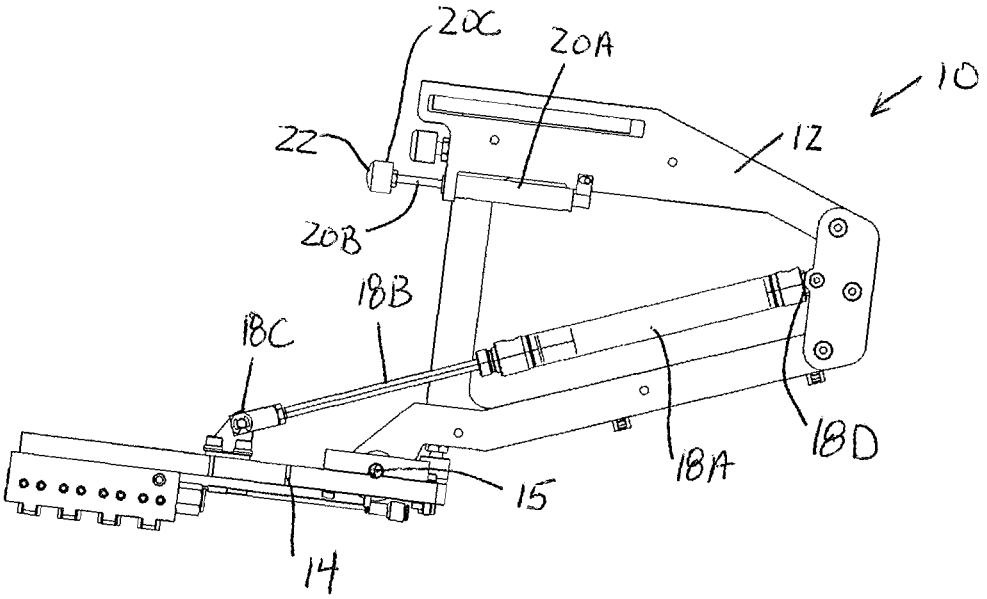
FIG. 5 is a top plan view of the labeling assembly in a leading side label apply orientation.

Referring to FIGS. 1-5, the labeling assembly 10 is shown in isolation, and includes frame components 12 and 14. Frame component 14 is pivotally mounted to frame component 12 for movement between a label load position (FIG. 3), a lateral side label apply position (FIG. 4) and a leading side label apply position (FIG. 5). Here, the frame component 14 pivots about a pivot axis 15. A vacuum applicator pad or head 16, with an associated set of ports 16A, is carried on the frame component 14 for movement with the frame component. An actuator 18 is configured for pivoting the frame component 14 between the label load position and the leading side label apply position, and an actuator 20 is configured for pivoting the frame component from the label load position to the lateral side label apply position. As shown, the pivot position of the frame component 13 when in the later label apply position (FIG. 4) is located between pivot position of the frame component 14 when in the label load position and the pivot position of the frame component 14 when in the first label apply position.

In the illustrated embodiment, the 18 actuator comprises a pneumatic actuator with a cylinder 18A and a rod 18B, wherein the rod 18B is movable relative to the cylinder 18A. The rod 18B has a distal end 18C that is pivotally connected to the frame component 14 so that extension of the rod 18B from the cylinder 18A will push the frame component 14 from the label load position (FIG. 3) to the leading side label apply position (FIG. 5), and retraction of the rod 18B into the cylinder 18A will pull the frame component 14 from the leading side label apply position (FIG. 5) back to the label load position (FIG. 3). The actuator 20 comprises a pneumatic actuator with a cylinder 20A and a rod 20B movable relative to the cylinder 20A. The rod 20B has a distal end 20C that is engageable with the frame component 14 so that extension of the rod 20B from the cylinder 20A will push the frame component 14 from the label load position (FIG. 3) to the lateral side label apply position (FIG. 4).

Notably, the frame component 14 is spaced away from the distal end 20C of the rod 20B when the frame component 14 is in the leading side label apply position. Thus, the distal end 20C contacts the frame component 14 in certain positions of the frame component 14, but the distal end 20C is not fixedly or pivotally connected to frame component 14. Here, the distal end 20C is formed at least in part by a bumper 22 for engaging the frame component 14. The bumper 22 may, for example, be of a rubber or other pliable material that provides some shock absorption characteristics.

In the illustrated embodiment, the cylinder 18A is connected to the frame component 12, in particular at end 18D by a pivotal connection. The cylinder 20A is connected to the frame component 12, in particular with a fixed connection (no relative pivot).

Thus, in the illustrated embodiment, the actuator 18 is a linear actuator, and includes a stroke length 24. The actuator 18 is a linear actuator, and includes a stroke length 26. Notably, the stroke length 24 is at least twice the stroke length 26 (e.g., stroke length 24 at least three times the stroke length 26). Of course, variations are possible.

In terms of operation of the actuators 18 and 20, where each actuator is a linear pneumatic actuator it may be configured as a dual action actuator, with pneumatic ports for control In particular, actuator 18 includes pneumatic port 30A to which pressure is applied to extend the actuator, and a pneumatic port 30B to which pressure is applied to retract the actuator rod. Likewise, actuator 20 includes a pneumatic port 32A to which pressure is applied to extend the actuator, and a pneumatic port 32B to which pressure is applied to retract the actuator rod. The actuators 18 may also be placed in a passive condition (e.g., no pressure applied to either pneumatic port, with air free to flow into or out of both sides of the cylinder). This passive condition will allow extension or retraction of the actuator if some external force is applied.

By way of example, and as schematically depicted in FIG. 3, a pressurized air source 34 may be provided. Each pneumatic port of actuator 18 is selectively connectable to received pressurized air via a respective air path 36A, 36B (e.g., formed by pneumatic hosing or other type of line) under control of a valve or respective valves 38. The valves 38 can be positioned to connect each pneumatic port to the pressurized air (for active extension or retraction) or to ambient (to allow free outflow or inflow of air). Likewise, each pneumatic port of actuator 20 is selectively connectable to receive pressurized air via a respective air path 40A, 40B (e.g., formed by pneumatic hosing or other type of line) under control of a valve or set of valves 42. The valves 42 can be positioned to connect each pneumatic port to the pressurized air (for active extension or retraction) or to ambient (to allow free outflow or inflow of air). By way of example, when actuator 18 is being actively extended, pneumatic port 18A would be connected to pressurized air and pneumatic port 18B would be connected to ambient. Conversely, when actuator 18 is being actively retracted, pneumatic port 18A would be connected to ambient and pneumatic port 18B would be connected to pressurized air. Actuator 20 operates in a similar manner.

A controller 50 is connected to control the valves 38, 40, and may also be connected to control the pressurized air source itself if necessary. As used herein, the term controller is intended to broadly encompass any circuit (e.g., solid state, application specific integrated circuit (ASIC), an electronic circuit, a combinational logic circuit, a field programmable gate array (FPGA)), processor(s) (e.g., shared, dedicated, or group—including hardware or software that executes code), software, firmware and/or other components, or a combination of some or all of the above, that carries out the control functions of the machine or the control functions of any component thereof.

As also shown schematically in FIG. 3, an pneumatic line 44 that is connected to the vacuum head 16 includes associated air path(s) 46 and valve(s) 48 to enable the head to be connected to a vacuum source 52 (e.g., to pull a vacuum at ports 16A in order to hold a label on the vacuum head) or to the pressurized air source 34 (e.g., to jet air out of the ports 16A so as to blow a label off of the head 16 and onto an item (e.g., a box, carton, or other package).

Figure 6:
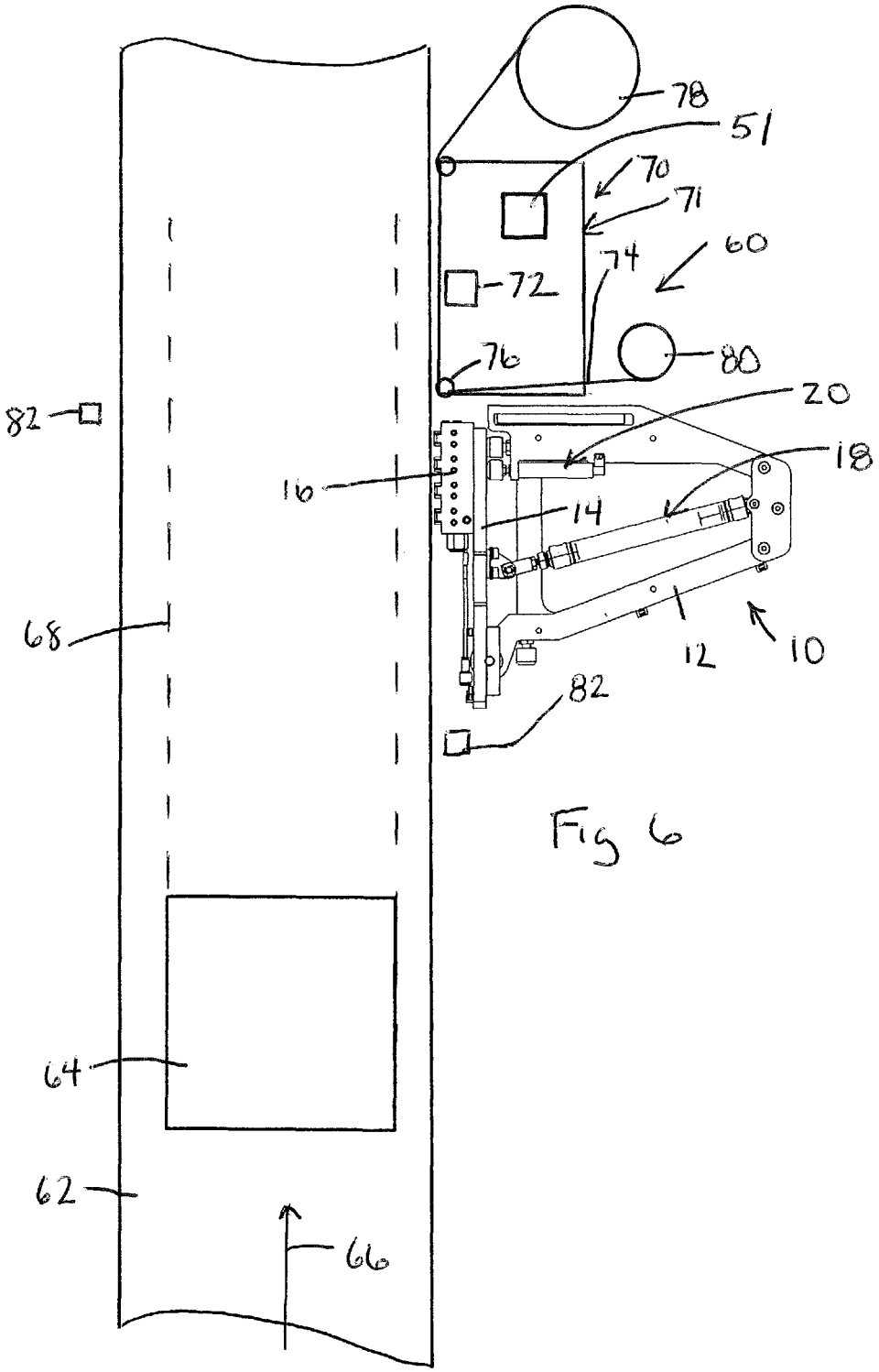
FIGS. 6-8 show top plan views of a labeling system during various stages of label application to an item moving along a conveyor.
Figure 7:
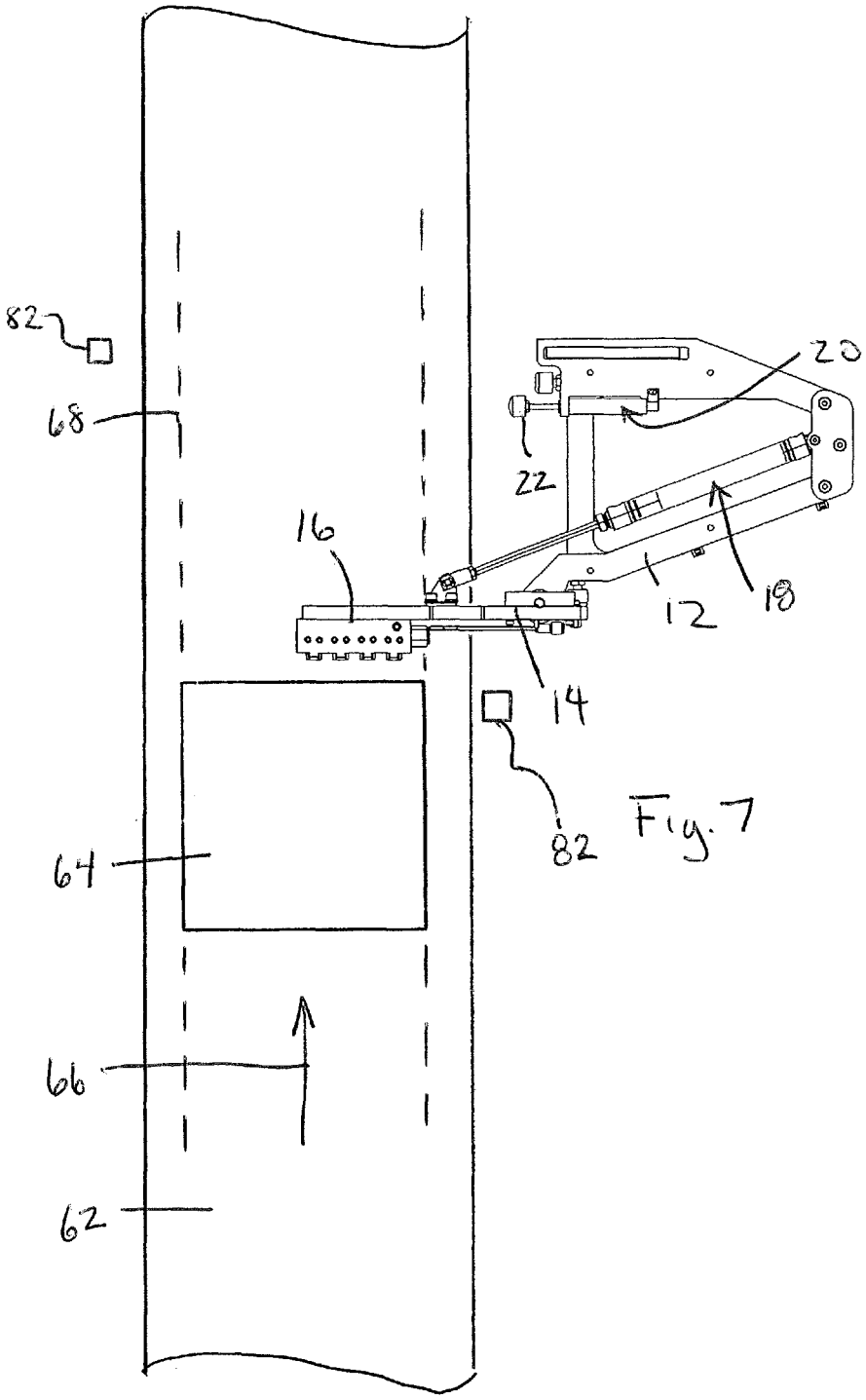
Figure 8:
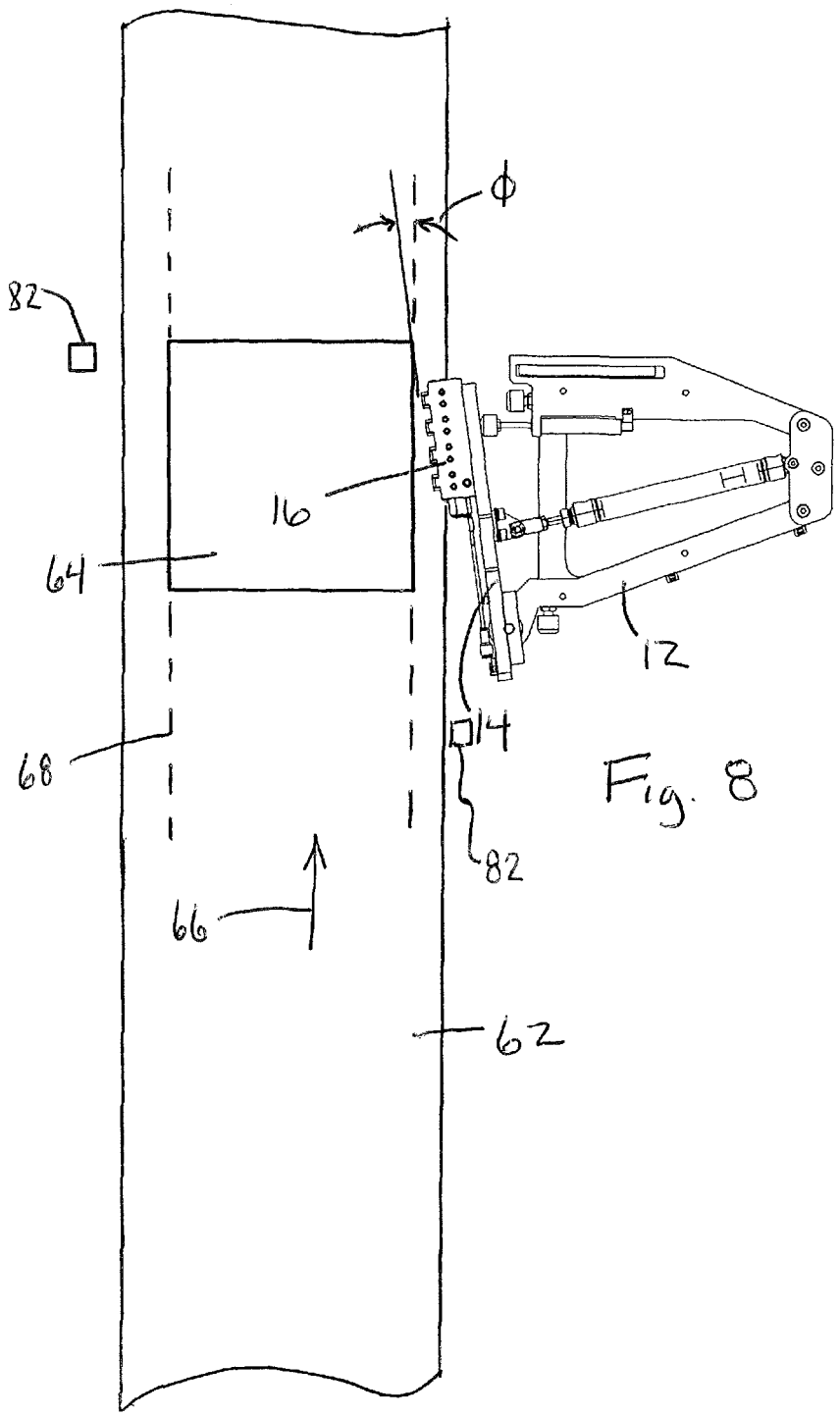

Referring now to FIGS. 6-8, a labeling system 60 includes conveyor 62 along which items 64 to be labeled can be conveyed in a conveyance direction 66 along a conveyance path 68. As suggested, the conveyance path 68 may be the actual path followed by an item as the item travels on the conveyor 62. The labeling assembly 10 is positioned alongside the conveyance path 68. In FIG. 6, the frame component 14 is in the label load position. In this regard, a label feed device 70 (only shown in FIG. 6 for simplicity), which may be formed by part of a printer applicator 71 that includes an associated label print head 72, is positioned for feeding labels onto the label applicator (e.g., onto the vacuum head 16) when the label applicator is in the label load position. Printed labels may, for example, be peeled away from a label liner 74 when the label liner is turned sharply around a peel bar 76 after the labels are printed. A label supply roll 78 and liner take up roll 80, one or both of which may be motor driven, are also shown.

Here, the vacuum applicator includes a face (e.g. comprising the ports 16A not shown in FIGS. 6-8) for holding a label. In the label load position of FIG. 6, the face has a label load orientation in which the face is substantially parallel to the conveyance direction 66. In the leading side label apply position of FIG. 6, the face has an apply orientation in which the face is substantially perpendicular to the conveyance direction 66. In the lateral side label apply position of FIG. 7, the face has an apply orientation in which the face is angularly offset from the conveyance. By way of example, the angle of offset Φ may be between about five degrees and about fifteen degrees, though variations are possible.

As mentioned above, the controller, which here may be formed at least in part by a printer applicator ECM 51, is connected for controlling both the actuators 18 and 20. For the purpose of labeling an item, the controller is configured to maintain both actuators 18 and 20 in their retracted states to place the frame component 14 in the label load position of FIG. 6 while a first label is loaded onto the vacuum applicator. The controller also assures a vacuum at the vacuum head ports to hold the label. The controller is configured to then cause the actuator 18 to move to its extended state in order to pivot the frame component 14 into the leading side label apply position of FIG. 7 for application of the first label to a leading side of the item 64 moving in the conveyance direction along the conveyance path 68. As indicated above, the first label may be applied by jets of air from the vacuum head so that the vacuum head need not actually contact the moving item 64. The controller is configured to then cause the actuator 18 to move to its retracted state, out of the path of the moving item 64, in order to move the frame component back into the label load position of FIG. 6 while a second label is loaded onto the vacuum applicator. Once the second label is loaded, the controller is configured to cause the actuator 20 to move to its extended state in order to pivot the frame component 14 into the lateral side label apply position of FIG. 8 for application of the second label to a lateral side of the item 64 moving in the conveyance direction 64 along the conveyance path 68. Again, the controller may initiate jets of air from the vacuum head for the purpose of applying the label.

The controller may be configured to cause both actuators 18 and 20 to move to their extended states in order to pivot the frame component 14 out of the label load position of FIG. 6 and toward the leading side label apply position. The additional movement force initially provided by the actuator 20 enhances the speed of movement of the frame component 14, and thus the overall labeling speed of the system. By way of example, a full sequence of (i) pivoting the label applicator fully out, (ii) blowing off the label to the leading side of the item, (iii) returning the label applicator to position to pick up a next label and (iv) feeding the next label onto the applicator can take as little as 2-3 seconds. The sequence to move the label applicator, apply the side label and return the label application is much shorter. In testing, labeling speeds of 20-25 products/items per minute have been achieved.

When moving the frame component 14 from the position of FIG. 7 back into the position of FIG. 6, the controller may be configured to cause the actuator 18 to move to its retracted state while the actuator 20 remains passively in its extended state, such that the frame component 14 pivots into contact with the bumper 22 on the actuator 20 prior to the frame component 14 reaching the label load position of FIG. 6. In this manner, the actuator 20 cushions the movement of the frame component 14 as it completes its pivot back into the label load position.

When the actuator 20 is extended to move the frame component 14 from the position of FIG. 6 to the position of FIG. 8, the controller is configured to place the actuator 18 in a passive state, which allows the actuator 18 to partially extend as the frame component 14 pivots. After the label is applied to the side of the item, the controller is configured to cause the actuator 18 to actively move back to its retracted state in order to move the frame component 14 back into the label load position.

The labeling system thus provides an advantageous method of applying labels to an item 64 moving in a conveyance direction 66 along a conveyance path 68. The method involves utilizing a pivotal label applicator 14 that is in a label load position (FIG. 6) out of the conveyance path. Next, loading a first label onto the label applicator when the label applicator is in the label load position is carried out. Next, pivoting the label applicator into the conveyance path such that the first label is oriented with an adhesive side facing a leading side of the item 64 (FIG. 7), and ejecting the first label from the label applicator and onto the leading side is carried out. Next, pivoting the label applicator away from the conveyance path and back into the label load position (FIG. 6) is carried out. Next, loading a second label onto the label applicator when the label applicator is in the label load position is carried out. Next, pivoting the label applicator 14 toward the conveyance path 68 such that an adhesive side of the second label is alongside a lateral side of the item 64 (FIG. 8), and ejecting the second label from the label applicator and onto the lateral side of the item is carried out.

Both label ejecting steps can be accomplished by blowing the labels off of the label applicator. As indicated above, the pivotal label applicator may include first and second linear actuators. Both linear actuators may be actively extended in order to pivot the label applicator out of the label load position when the label applicator is being moved to the leading side label apply position. Only the second label applicator is actively extended in order to pivot the label applicator into the lateral side label apply position, while the first label applicator partially extends in a passive manner.

The timing for controlling the actuators 18 and 20, as well as the label feed device 70, may be achieved in a variety of ways. For example, the controller 50 may monitor outputs from one or more sensors 82 (e.g., optical, electromagnetic and/or mechanical) that detect item position along the conveyor 62. Other techniques could also be used in lieu of sensors, such as timing the control sequence based upon one or more other system conditions or parameters. The timing of actuation of actuators 18 and 20 and length of time actuated can be controlled by firmware residing on the controller (e.g., firmware residing on a board in the printer applicator electronic module 51). However, other implementations are possible.

It is to be clearly understood that the above description is intended by way of illustration and example only, is not intended to be taken by way of limitation, and that other changes and modifications are possible.

What is claimed is:

1. A labeling system, comprising:

a frame component pivotal between a label load position, a first label apply position and a second label apply position;

a vacuum applicator carried on the frame component for movement with the frame component;

a first actuator configured for pivoting the frame component between the label load position and the first label apply position;

a second actuator configured for pivoting the frame component from the label load position to the second label apply position;

wherein the second label apply position is an intermediate pivot position that is located between the label load position and the first label apply position;

wherein:

the first actuator is a first linear actuator having a first stroke length;

the second actuator is a second linear actuator having a second stroke length;

wherein the first stroke length is at least twice the second stroke length.

2. The labeling system of claim 1, wherein:

the first actuator comprises a first pneumatic actuator with a first cylinder and a first rod, wherein the first rod is movable relative to the first cylinder, the first rod having a distal end that is pivotally connected to the frame component so that extension of the first rod from the first cylinder will push the frame component from the label load position to the first label apply position and retraction of the first rod into the first cylinder will pull the frame component from the first label apply position to the label load position;

the second actuator comprises a second pneumatic actuator with a second cylinder and a second rod movable relative to the second cylinder, the second rod having a distal end that is engageable with the frame component so that extension of the second rod from the second cylinder will push the second frame component from the label load position to the second label apply position.

3. The labeling system of claim 2, wherein the frame component is spaced away from the distal end of the second rod when the frame component is in the first label apply position.

4. The labeling system of claim 3, wherein the distal end of the second rod comprises a bumper for engaging the frame component.

5. The labeling system of claim 2, wherein:

the frame component is a first frame component that is pivotally mounted to a second frame component;

the first cylinder is connected to the second frame component;

the second cylinder is connected to the second frame component.

6. The labeling system of claim 1, wherein the first stroke length is at least three times the second stroke length.

7. The labeling system of claim 1, wherein:

the frame component is a first frame component that is pivotally connected to a second frame component, and the second frame component remains stationary;

the first linear actuator includes a first part pivotally connected to the first frame component and a second part pivotally connected to the second frame component;

the second linear actuator includes a first part fixedly connected to the second frame component and a second part that engages with the first frame component when the first frame component is in the label load position and the second label apply position, wherein the second part does not engage with the first frame component when the first frame component is in the first label apply position.

8. The labeling system of claim 1, further comprising:

a conveyance path along which items to be labeled can be conveyed in a conveyance direction;

wherein the frame component is positioned alongside the conveyance path when the frame component is in the label load position;

wherein the vacuum applicator includes a face for holding a label;

wherein, in the label load position, the face has a label load orientation in which the face is substantially parallel to the conveyance direction;

wherein, in the first label apply position, the face has a first apply orientation in which the face is substantially perpendicular to the conveyance direction;

wherein, in the second label apply position, the face has a second apply orientation in which the face is angularly offset from the conveyance direction by between about five degrees and about fifteen degrees.

9. The labeling system of claim 1, further comprising:

a conveyance path along which an item to be labeled can be conveyed in a conveyance direction;

wherein the frame component is positioned alongside the conveyance path when in the label load position;

wherein the first actuator is a linear actuator having an extended state and a retracted state;

wherein the second actuator is a linear actuator having an extended state and a retracted state;

a controller connected for controlling both the first actuator and the second actuator, wherein the controller is configured to:

(a) maintain the first actuator in its retracted state and maintain the second actuator in its retracted state to place the frame component in the label load position while a first label is loaded onto the vacuum applicator;

(b) cause at least the first actuator to move to its extended state in order to pivot the frame component into the first label apply position for application of the first label to a leading side of the item moving in the conveyance direction along the conveyance path;

(c) cause at least the first actuator to move to its retracted state in order to move the frame component back into the label load position while a second label is loaded onto the vacuum applicator; and (d) cause the second actuator to move to its extended state in order to pivot the frame component into the second label apply position for application of the second label to a lateral side of the item moving in the conveyance direction along the conveyance path.

10. The labeling system of claim 9, wherein the controller is configured to:

in step (a), cause both the first actuator to move to its extended state and the second actuator to move to its extended state in order to pivot the frame component out of the label load position;

in step (c), cause the first actuator to move to its retracted state while the second actuator is in its extended state such that the frame component pivots into contact with the second actuator prior to the frame component reaching the label load position, and the second actuator cushions the movement of the frame component as it completes pivot into the label load position.

11. The labeling system of claim 10, wherein:

in step (d), the movement of the second actuator into its extended state causes the first actuator to partially extend; and the controller is configured to, following step (d), cause the first actuator to move back to its retracted state in order to move the frame component back into the label load position.

12. The labeling system of claim 1, wherein a movable distal end of the second actuator is not fixedly or pivotally connected to the frame component, such that the frame component is not in contact with the movable distal end when frame component is in the first label apply position.

13. The labeling system of claim 1, further comprising:

a controller connected for controlling both the first actuator and the second actuator, wherein the controller is configured to:

(a) maintain the first actuator in its retracted state and maintain the second actuator in its retracted state to place the frame component in the label load position while a first label is loaded onto the vacuum applicator;

(b) cause at least the first actuator to move to its extended state in order to pivot the frame component into the first label apply position for application of the first label;

(c) cause at least the first actuator to move to its retracted state in order to move the frame component back into the label load position while a second label is loaded onto the vacuum applicator; and (d) cause the second actuator to move to its extended state in order to pivot the frame component into the second label apply position for application of the second label.

14. A labeling system, comprising:

a conveyor for moving an item in a conveyance direction along a conveyance path;

a label applicator pivotal between a label load position, a lateral side label apply position and a leading side label apply position, wherein, in the label load position, the label applicator is alongside the conveyance path, wherein, in the leading side label apply position, the label applicator is pivoted into the conveyance path, wherein, in the lateral side label apply position the label applicator is pivoted out of the label load position and closer to the conveyance path, wherein the lateral side label apply position is an intermediate pivot position between the label load position and the leading side label apply position;

a label feed device positioned for feeding a label onto the label applicator when the label applicator is in the label load position;

an actuating assembly for controlling pivot of the label applicator;

a controller associated with the actuating assembly, the label feed device and the label applicator for control thereof, the controller configured to:

(a) control the label feed device to feed a first label onto the label applicator when the label applicator is in the label load position;

(b) control the actuating system to pivot the label applicator into the leading side label apply position such that the first label is oriented with an adhesive side facing a leading side of the item;

(c) control the label applicator to eject the first label from the label applicator and onto the leading side of the item;

(d) control the actuating assembly to pivot the label applicator out of the conveyance path and back into the label load position;

(e) control the label feed device to feed a second label onto the label applicator when the label applicator is in the label load position;

(f) control the actuating assembly to pivot the label applicator toward the conveyance path into the lateral side label apply position such that an adhesive side of the second label is alongside a lateral side of the item; and (g) control the label applicator to eject the second label from the label applicator and onto the lateral side of the item;

wherein the actuating system comprises a first linear pneumatic actuator that is extended to pivot the label applicator into the leading side label apply position in step (b), and pneumatic actuator that is extended to pivot the label applicator into the lateral side label apply position in step (f).

15. The labeling system of claim 14, wherein the label applicator comprises a vacuum head, and the controller is configured to control ejection of the first label in step (c) by blowing air from the vacuum head and to control ejection of the second label in step (g) by blowing air from the vacuum head.

* * * * *